United States Patent [19]

Rosauer et al.

[11] 4,238,788

[45] Dec. 9, 1980

[54] SYSTEM FOR DETECTING A COMBUSTION PROCESS

[75] Inventors: Robert J. Rosauer; James F. Gamble, Jr., both of Ft. Collins, Colo.

[73] Assignee: Teledyne Industries, Inc., Ft. Collins, Colo.

[21] Appl. No.: 866,383

[22] Filed: Jan. 3, 1978

[51] Int. Cl.[2] ..... G08B 17/10; H01H 3/12; H01H 13/52

[52] U.S. Cl. ..... 340/515; 200/159 A; 200/340; 250/381; 313/54; 340/629

[58] Field of Search ..... 340/514, 515, 629, 628, 340/636; 313/54; 250/381, 382, 384, 385; 200/159 A, 295, 314, 340

[56] References Cited

U.S. PATENT DOCUMENTS

| | | | |
|---|---|---|---|
| 2,415,297 | 2/1947 | Linton | 200/340 |
| 3,235,858 | 2/1966 | Mäder | 340/514 |
| 3,717,862 | 2/1973 | Sasaki | 340/514 |
| 3,812,362 | 5/1974 | Larsen et al. | 340/629 A |
| 3,866,195 | 2/1975 | Ried, Jr. | 340/629 |
| 3,906,474 | 9/1975 | Lehsten | 340/629 |
| 3,909,815 | 9/1975 | Gacogne | 340/629 |
| 4,004,288 | 1/1977 | Webb, Jr. | 340/636 X |
| 4,012,729 | 3/1977 | Weaver et al. | 340/629 |
| 4,081,684 | 3/1978 | Wieder | 340/515 |
| 4,083,037 | 4/1978 | Larsen | 340/629 |
| 4,153,840 | 5/1979 | Wieder | 250/385 |

*Primary Examiner*—John W. Caldwell, Sr.
*Assistant Examiner*—Daniel Myer
*Attorney, Agent, or Firm*—Hugh H. Drake

[57] ABSTRACT

An ionization type smoke detector includes an element for giving a visible indication of operativeness of the system together with a component responsive thereto for representing impending failure of the power source. A housing for the system includes a battery-containing well that includes a channel permitting finger-access to the batteries. A pushbutton is located in a wall of the housing. An electrically-conductive probe is positioned within an ionization chamber and is associated with the pushbutton for addressing the probe in a manner that creates a simulation of the existence of combustion. In response to a signal from the ionization chamber, digital processing is employed in order to enable alarm indication as appropriate as well as to monitor continued capability of the battery power source. Special circuitry cooperates advantageously with those features as well as in interrelating the different features so as to minimize complexity.

12 Claims, 18 Drawing Figures

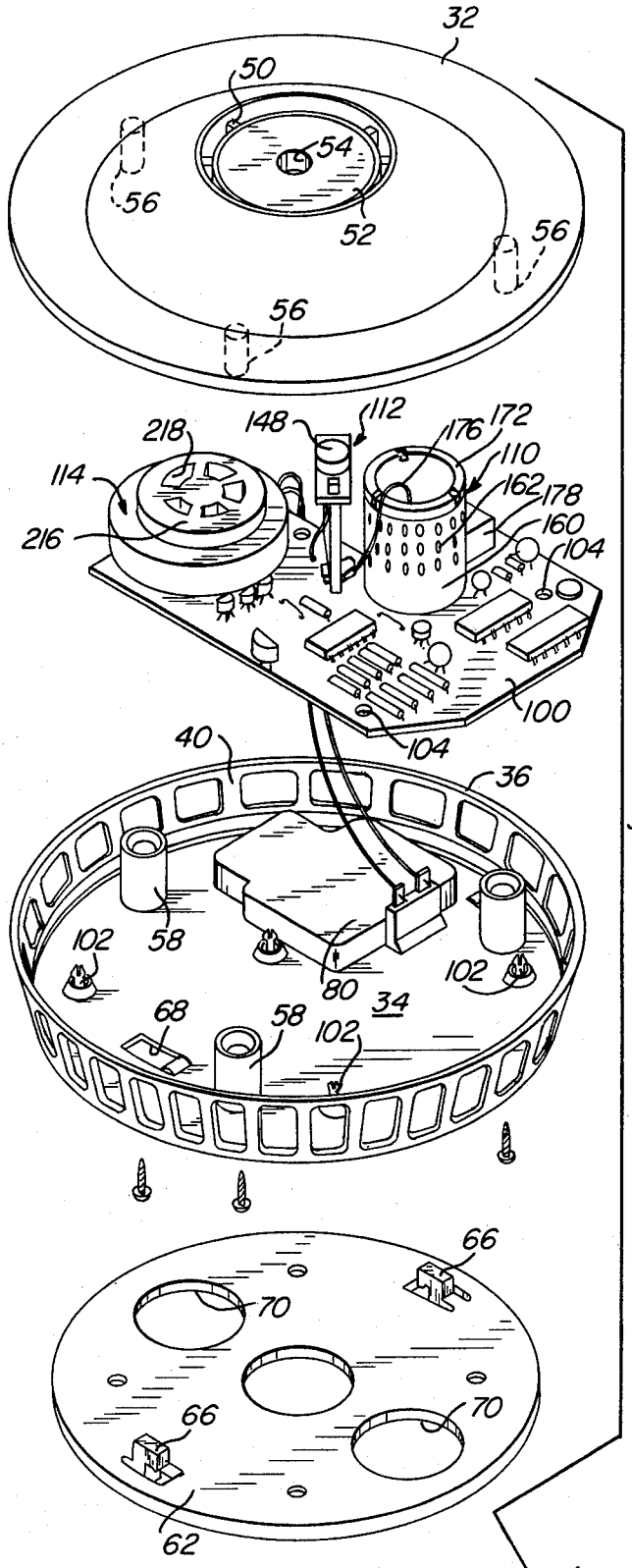
Fig-5
Fig-6
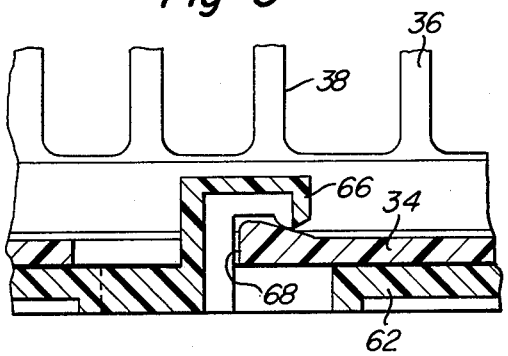
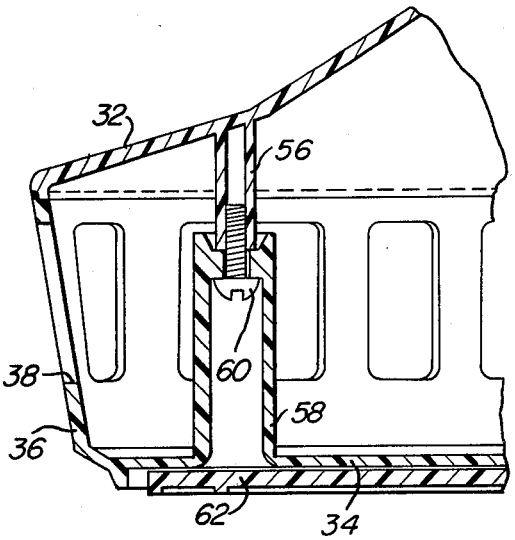
Fig-7
Fig-8
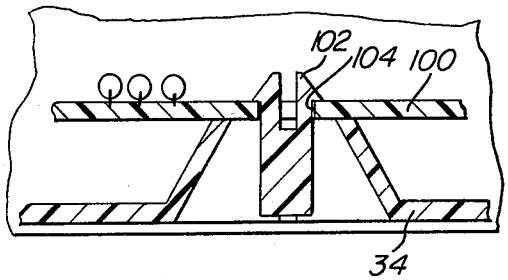

148
140
150
144
146
142
120
122
136
124
132
130
126
100
128

172
176
174
162
160
170
178
168
180
182
167
166
164
163

SYSTEM FOR DETECTING A COMBUSTION PROCESS

The present invention pertains to a system for detecting a combustion process. More particularly, it relates to a system which senses the existence of such process and also enables monitoring and control of its manner of operation.

The need for detectors that sense and give a warning of existing or even incipient fire or other combustion process has long been recognized. Among the earliest systems were those which responded simply to an increase in temperature beyond a pre-selected value. In related systems that followed, the alarm was caused to be responsive to an abnormal rate of increase in temperature.

One now long-known alternative approach employs a photoelectric sensor to detect obscuration of a light beam by visible smoke particles. This technique has the advantage of not being highly subject to variations in ambient temperature or pressure. However, such systems are subject to disadvantages arising from the effects of circulating air currents, expensive complexity of design so as to insure that a representative sample is observed in the light beam and other matters.

Of significant interest as a further alternative has been the so-called ionization detector. It has long been known that a change in current flow between a pair of electrodes may be caused to occur by the presence of smoke particles. Without more, the ionization current required as an input to an alarm-sounding system can be obtained by the creation between those electrodes of a very high electric field. Since the high voltage necessary is at least inconvenient, the art rather quickly adapted to the early suggestion of disposing a radioactive source within the ionization chamber. That source emits one or more of alpha, beta and gamma rays or particles. The energy emitted from the source causes an ionization of the air and of any particles entering the chamber. Upon the admission of smoke particles or other products of combustion, a change in current flow between the electrodes occurs, and this is sensed by a suitable electronic device such as a cold-cathode or gas tube or a solid state device such as a field-effect transistor.

With progress in the art, sophistication of approach has occurred in the design of the ionization chambers themselves and in the circuitry which responds thereto in order to sound the alarm. As contrasted with the photoelectric approach, an advantage of the ionization-type smoke or fire detector is that it may respond to invisible combustion products. At the same time, any undesired temperature dependence may be compensated. Numerous refinements have been made in order to minimize problems arising from unwanted changes in such parameters as barometric pressure and circulating air currents.

Such progress has led to the publication of numerous proposals, technical papers and patents. In fact, the prior art is so extensive as to preclude total reference. Representative of an earlier ionization-type detection approach would be U.S. Pat. No. 2,702,898-Meili. That patent employs the dual-chamber technique with a junction between the chambers being fed to circuitry which observes the effect of a change in ionization current in order to cause the sounding of an alarm. It also teaches the compensation aspects of having two sides of the chamber operate at ambient air pressure. U.S. Pat. No. 3,271,756-Crawford et al illustrates another attempt at improved circuitry as well as in providing ionization chambers of a kind permitting electric field adjustability in order to obtain proper operation. U.S. Pat. No. 3,657,713-Sazaki sought to enable adequate testing of system operation by applying a varying voltage across the chambers.

Related progress has been made in aspects apart from the detection process itself. For example, U.S. Pat. No. 3,657,737-Hamm et al pertains to a system wherein different detection units may be slaved to a common central station for receiving the ultimate indication of an alarm condition. U.S. Pat. No. 3,693,110-Briggs et al discusses an approach in which a single alarm circuit, such as a fire detector, may be capable of selective programming so as to provide different kinds of signals which respectively represent different kinds of alarms or different locations. U.S. Pat. No. 3,594,751-Ogden et al teaches the desirability of monitoring supply battery voltage, using a second supervisory battery for that purpose. U.S. Pat. No. 3,778,800-Blackwell et al is similar, sounding a distinctive alarm to indicate a low voltage condition. U.S. Pat. No. 3,899,732-Staby periodically loads a battery in order to determine changes in its internal impedance. The variety of this different prior art indicates that the entire field of smoke and fire detection has reached a significant level of maturity.

Notwithstanding the foregoing, acceptance of the use of smoke and fire detectors by the general populace has been comparatively slow. While industrial and business users have been among the first to recognize the need for such apparatus, their adoption and usage often has been dictated by insurance or regulatory requirements. Various safety organizations have in recent years been expounding the virtues of such apparatus especially for residential use, and several well-known manufacturers have entered the field. Advertising by manufacturers has assisted in educating individuals of the desirability of having this kind of protection in their homes. Fire department officials are now regularly quoted as recommending the kind of apparatus in question.

It is, accordingly, a general object of the present invention to provide a new and improved combustion detection apparatus.

Another object of the present invention is to provide a new and improved apparatus which features mechanical approaches to assembly of the structural components that accomplish better performance, improved reliability and the achievement of economy of manufacture.

A further object of the present invention is to provide a new and improved detector of the foregoing type which facilitates use and maintenance.

Still another object of the present invention is to provide a new and improved combustion process detector which best enables the appropriate alerting of the user.

A still further object of the present invention is to provide a new and improved combustion process detector which, through advanced structure, enables the achievement of fully adequate testing so as to insure protection.

Again more generally, it is an object of the present invention to take best advantage of the present state of the art as to components in order to provide a more useful detector and alarm of the kind in question.

The invention, thus, has to do with a system for detecting the existence of a combustion process and which includes means for sensing the existence of that process and means for indicating the appearance thereof. One improvement involves the association between means for giving a usable indication of operativeness of the system and means responsive to that giving means for representing impending failure of a power source for the system. Another improvement pertains to a housing that has spaced top and bottom walls, an inwardly-formed well defined in the top wall and sized to receive a single battery, a pair of electrical contacts projecting into the well and located to engage corresponding terminals on the battery, and with the well including at least one channel extending laterally from the battery and of a size to admit a human finger for enabling removal of the battery.

As a further feature, a resiliently-biased pushbutton is seated in an opening in the bottom wall and there is means responsive to pressure on that pushbutton for simulating the existence of the combustion process and effecting operation of the indicating means. In one form, the sensing means has an electrically conductive tube which is part of an ionization chamber, there is an electrically-conductive probe positioned within the tube, and the probe is addressed in a manner that it creates a simulation of the existence of a combustion process. Also included as features are a variety of circuitry approaches which pertain to ionization-chamber response, visual indication of operativeness, exhibition of a low-voltage condition of the battery and the generation of desired audible output alarm sound.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 5 is an exploded perspective view of the detector of FIG. 1;

FIG. 6 is a fragmentary cross-sectional view taken along the line 6—6 in FIG. 9;

FIG. 7 is a fragmentary cross-sectional view taken along the line 7—7 in FIG. 9;

FIG. 8 is a fragmentary cross-sectional view taken along the line 8—8 in FIG. 9;

Figure 1:
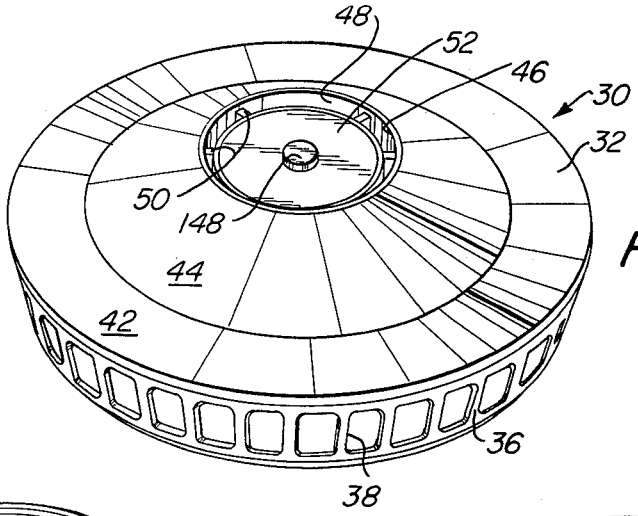
FIG. 1 is a perspective view of a combustion process detector, inverted with respect to one normal orientation.
Figure 2:
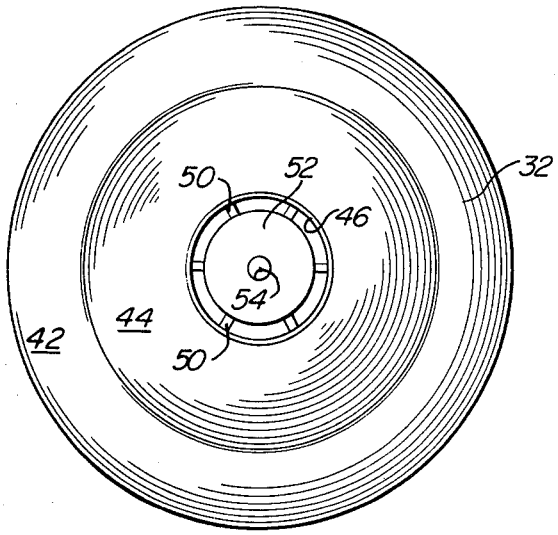
FIG. 2 is a bottom plan view of the detector of FIG. 1.
Figure 3:
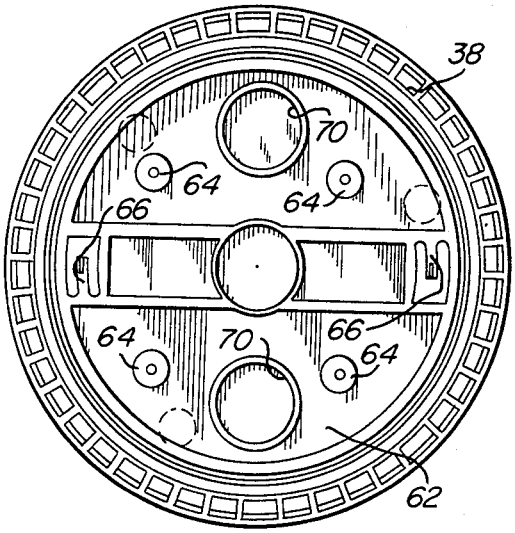
FIG. 3 is a top plan view of the detector of FIG. 1, including an attached mounting bracket.
Figure 4:
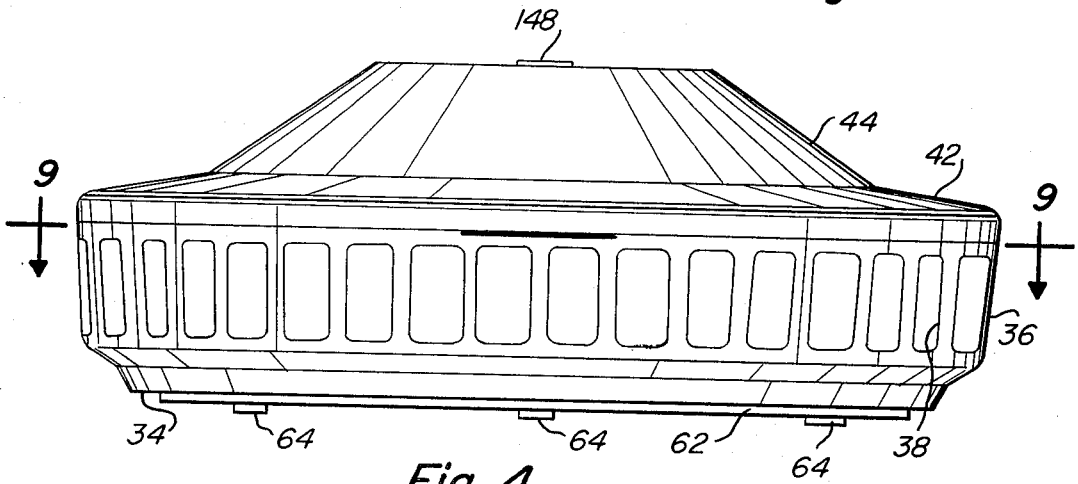
FIG. 4 is a side-elevational view of the detector shown in FIG. 1.

As indicated in the introduction, a primary purpose of this kind of unit is to give an alarm of the indication of fire or at least of the existence of the initiation of a combustion process which may indicate the likelihood of fire. Of course, the ultimate aim is to reduce loss by fire. Even without actual fire, however, smoke damage may be extensive in a given situation. In any case, the present apparatus is capable of responding even to invisible products of the beginning of combustion.

As illustrated, a smoke alarm unit 30 has a bottom wall or cover 32 which overlies a top wall 34. As used herein, "top" refers to the typical mounting whereby wall 34 is adjacent to a ceiling. However, the unit will function when mounted on a vertical wall, or it may, for example, rest on a shelf in the illustrated orientation. Top wall 34 has an integrally-formed upstanding side wall 36 in which are disposed a circumferentially-spaced succession of openings 38 that admit air to be sensed into the interior cavity 40 that is defined by the joinder of bottom wall 32 to the bottom peripheral margin of side wall 36.

Proceeding from the outer, peripheral margin of wall 32, there is a first surface 42 that slants slightly and then merges into a surface 44 of increased slant to its own inner periphery 46 which defines a central opening 48. Disposed across, but spaced from margin 46 by struts 50, is a plate 52 that has a central opening 54.

Depending interiorly away from wall 32 are a plurality of circumferentially-spaced bosses 56. Mating therewith are correspondingly disposed bosses 58 that project inwardly from wall 34. Screws 60 serve to secure the top and bottom wall portions together by means of those bosses.

In order to mount unit 30 to a structure such as a ceiling or a wall of a building, there is a mounting plate 62. Plate 62 has a number of features in common with that described in U.S. Pat. No. 4,032,707-Trenary, granted June 28, 1977, and assigned to the same assignee as the present application. Plate 62 includes a plurality of circumferentially-spaced bosses 64 through which suitable wood screws or other fasteners may be inserted for fastening the mounting plate on a substrate. A pair of diametrically opposed lugs 66 project toward wall 34 of the main housing and are individually engageable with respective openings 68 in wall 34, so as to enable the overall housing to be attached to bracket 62 by general alignment and then a slight rotation of the housing. Finger holes 70 in bracket 62 may assist in holding the bracket in proper position while drilling holes in the substrate for mounting the bracket. Not all details shown for bracket 62 in the drawings actually are required. For example, only two of the openings 64 are necessary in at least most practical installations, and these may be placed at different positions. No central opening between lugs 66 is necessary, although one is illustrated.

Recessed into wall 34 is a well 80 that defines a cavity 82 into which a battery 84 is received, so as to supply the necessary power for operation of all of the apparatus. The positive and negative terminals on battery 84 make contact with terminal strips 86 and 88. Channels 90 and 92 project laterally from battery compartment 80 so as to enable a finger of the user to be inserted under the battery and permit its dislodgment for inspection or replacement. The channels in which strips 86 and 88 are disposed have mutually different sizes so as to accept the correspondingly different sizes of the conventional nine volt battery terminals and thereby insure that the battery is connected with proper polarity.

Suspended within cavity 40 is a substrate 100 on which are mounted the primary electrical and electronic components other than battery 84. Substrate 100 is secured to wall 34 by means of stubs 102 that project away from wall 34, extend through holes 104 in the substrate and include resilient locking lugs for securing substrate 100 into place with respect to wall 34, all is shown in detail in FIG. 8.

Figure 9:
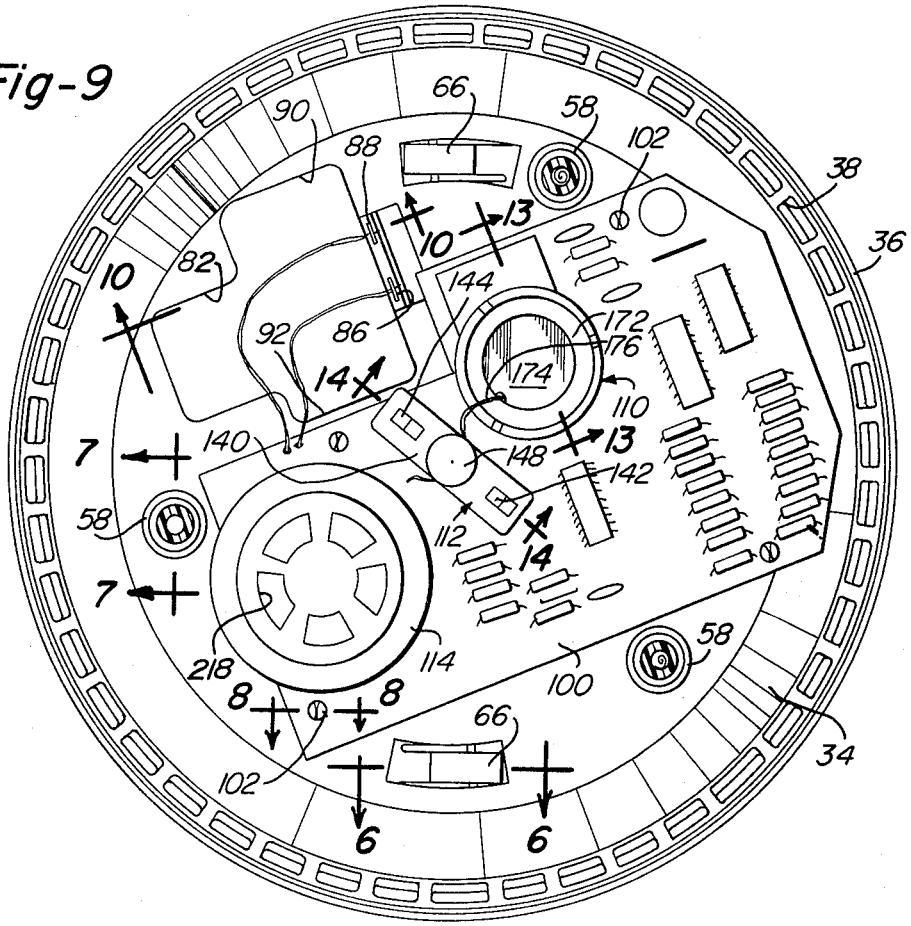
FIG. 9 is a cross-sectional view taken generally along the line 9—9 in FIG. 4, but with certain internal components shown complete.
Figure 10:
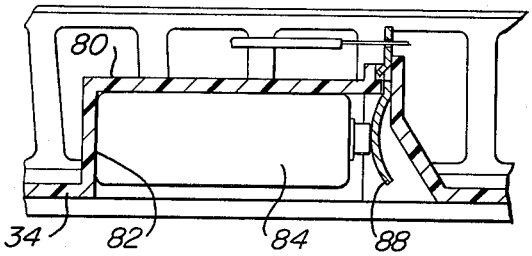
FIG. 10 is a fragmentary cross-sectional view taken along the line 10—10 in FIG. 9.
Figure 11:
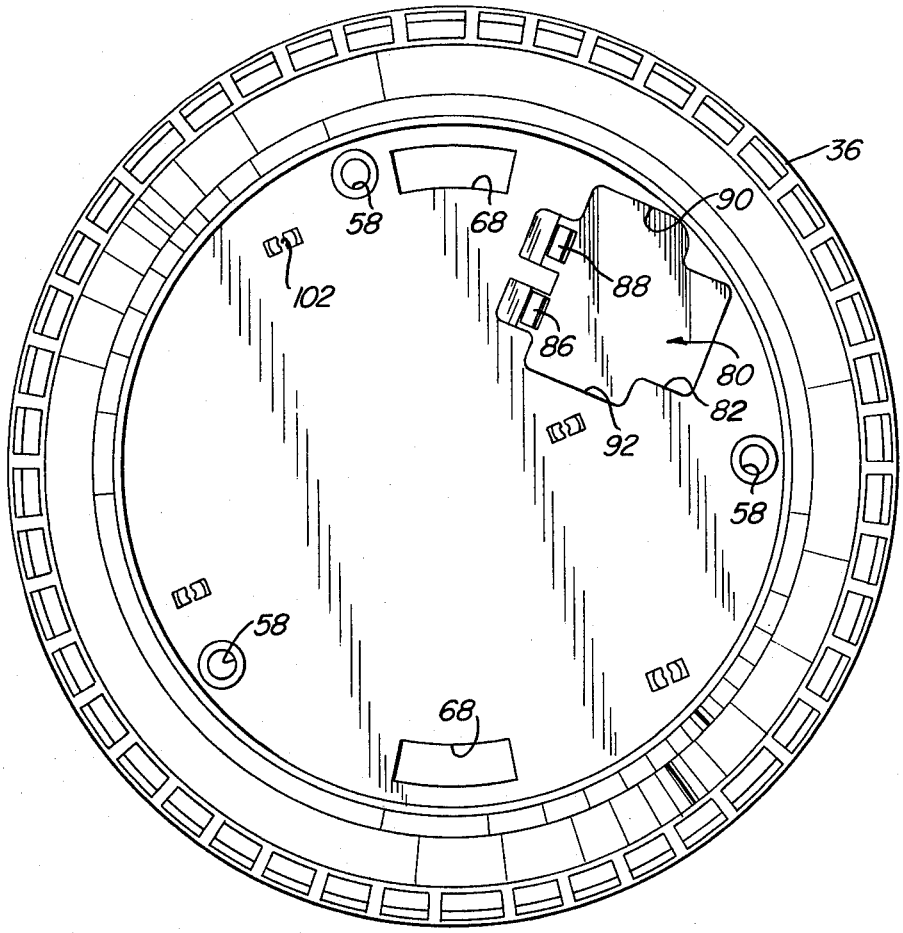
FIG. 11 is a top plan view similar to FIG. 3 but with a mounting bracket removed therefrom.
Figure 12:
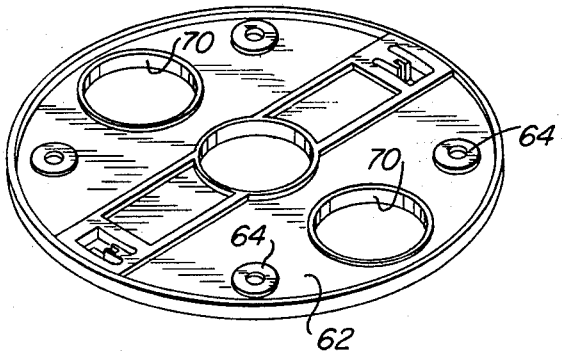
FIG. 12 is a perspective view of the top of that mounting bracket the lower side of which is shown in FIG. 5.
Figure 14:
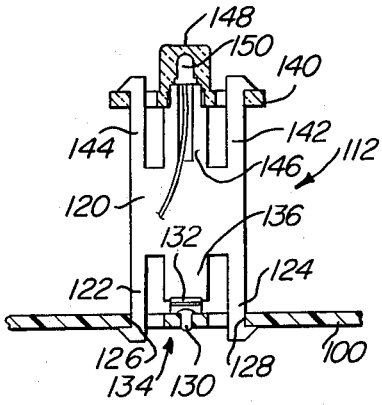
FIG. 14 is a fragmentary cross-sectional view taken along the line 14—14 in FIG. 9.

In itself, substrate 100 is a printed circuit board having means for mounting a variety of discrete components as well as carrying a number of conductive paths for innerconnecting those discrete components. Thus, and as will be readily recognized in FIGS. 5 and 9, there are such typical components as transistors, resistors, capacitors and integrated circuits. In addition, substrate 100 carries an ion chamber assembly 110, a switch assembly 112 and an alarm horn or acoustical transducer 114.

Alarm horn 114 may be entirely conventional. In principle, it is nothing more than a loudspeaker. When supplied with a signal input at audio frequencies, it supplies an acoustical output at that frequency or those frequencies. Switch 112 includes an upright standard 120 mounted slidably for vertical movement by legs 122 and 124 disposed within respective openings 126 and 128 formed through substrate 100. Carried on substrate 100 is a fixed contact 130 and a resilient contact 132, those contacts together defining a switch 134. Moreover, contact 132 is in the form of a leaf spring which biases a central leg 136 in a directiion away from substrate 100 so that standard 120 also is so biased.

Mounted upon the other end of standard 120 is a plate 140 captivated by side lugs on projecting legs 142 and 144 spaced apart from a hub 146. Projecting on beyond plate 140 is a pushbutton 148 that projects outwardly through opening 54. Housed within pushbutton 148 is a light-emitting diode (LED) 150 the two flexible leads from which extend back into contact with suitable terminals on substrate 100. Pressure upon the exposed surface of pushbutton 148, above opening 54, serves to move standard 120 downwardly and cause the closure of switch 134.

Ionization chamber 110 is outwardly defined by a tubular shell 160 of electrically conductive material. Apertures 162 circumferentially distributed around the upper portion of shell 160 serve to admit air, with or without combustion products, into that portiion of the interior of shell 160. At one end of shell 160 is an insulating washer 163 that supports a conductive metal plate 164 to which is mounted a centrally located radioactive material source 166. Preferably, source 166 is Am 241. Spaced from plate 164 by an insulating washer 167, and insulated from shell 160, is an annular washer 168 of conductive material. Captivating these components in place and within shell 160 is an insulating collar 170. Secured at the other end of shell 160 is an internally directed sleeve 172 of insulating material. Closing the internal opening in sleeve 172 is a conductive plate 174. Plate 174 is electrically connected back to a suitable terminal on substrate 100 by a lead 176. As illustrated, the parts snap together for ease of assembly. An electrically-conductive housing 178 projects outwardly from one side of shell 160 and is grounded on substrate 100 so as to serve as an electrostatic shield for a field effect transistor 180 disposed therein; its gate 182 is connected directly to conductive washer 168.

Figure 15:
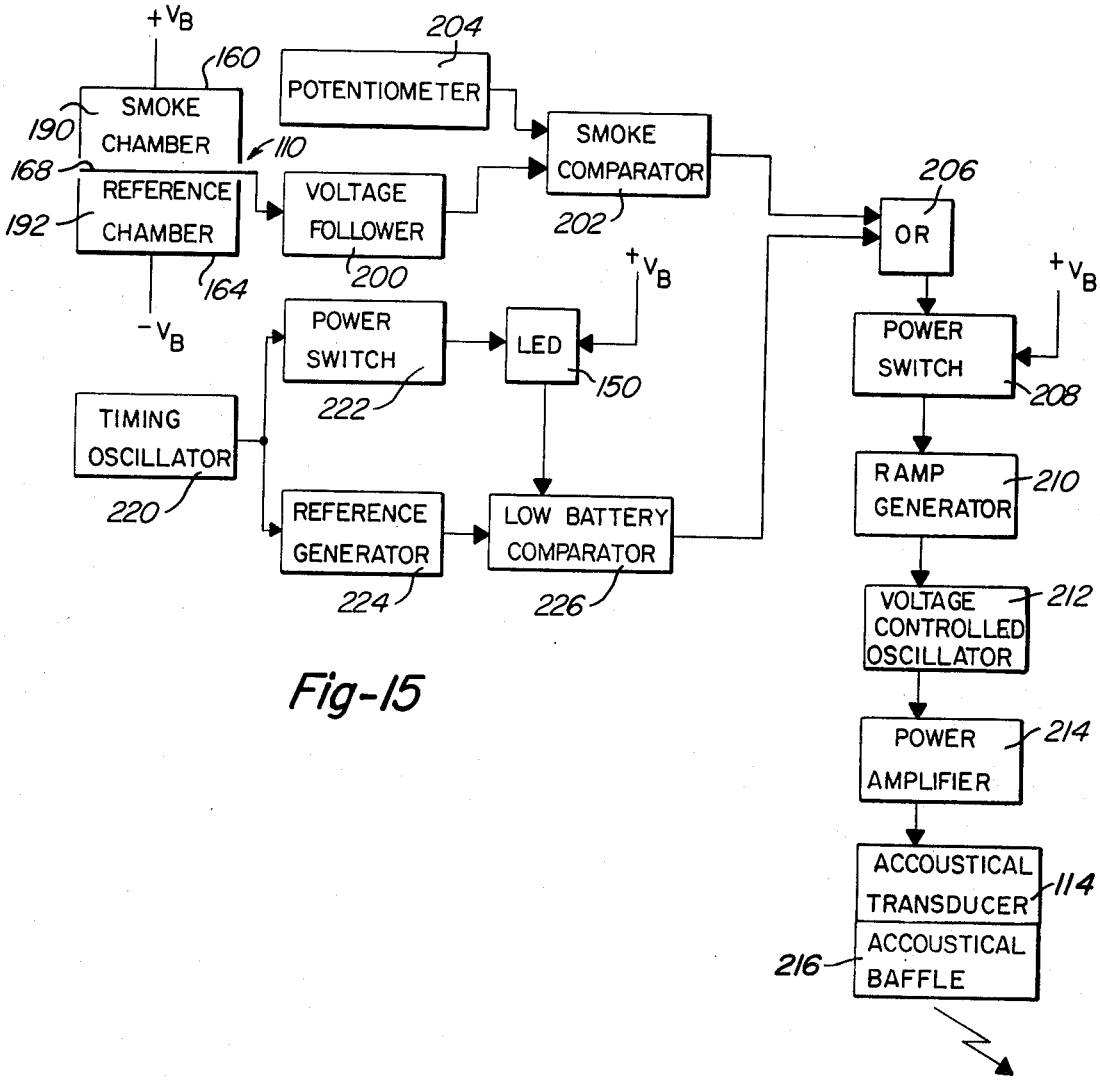
FIG. 15 is a block diagram of the embodied system.
Figures 13A, 14A:
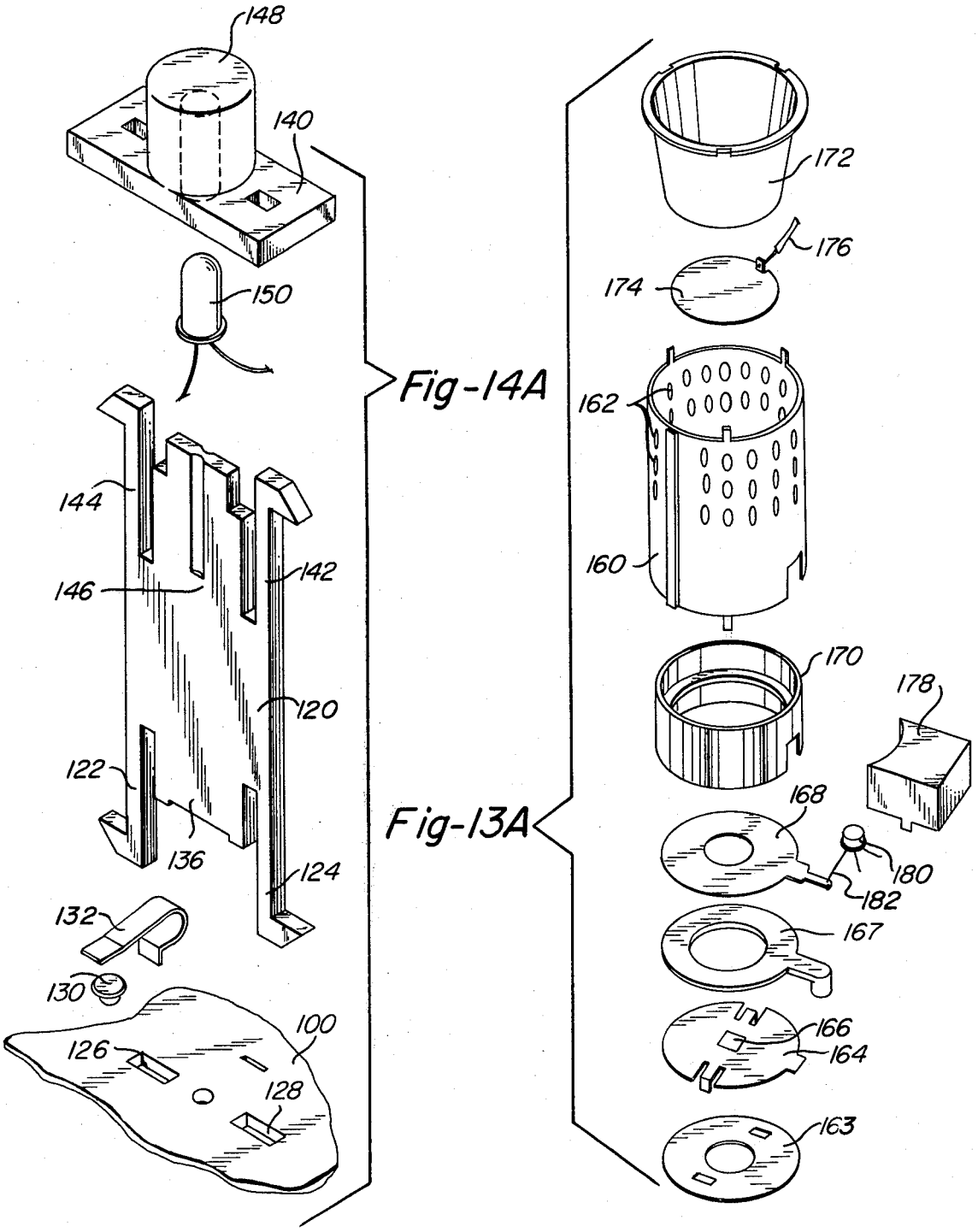
FIG. 13A is an exploded perspective view of a principal component featured in FIG. 13.
FIG. 14A is an exploded perspective view of the sub-assembly shown in FIG. 14.

As a general matter of overall operation, the volume within shell 160 on one side of washer 168 constitutes a smoke chamber 190. On the other hand, the volume within shell 160 on the other side of washer 168 constitutes a reference chamber 192. Emitter 166 is so located approximately in the bottom of chamber 192 as to emit particles through substantial portions of both chambers 190 and 192. While the physical structure of the chamber arrangement may be more easily viewed in FIG. 13, the block-diagram representation is shown in FIG. 15. Basically, FIG. 15 presents a preferred embodiment of the overall system arrangement as achieved by use of the components already described in detail together with the additional electronic components carried by substrate 100.

Within the ionization chamber assembly, shell 160 is connected to the positive terminal ($+V_B$) of battery 84 and serves as one electrode of smoke chamber 190. Conductive plate 164 is connected to the negative terminal ($-V_B$) and serves as one electrode of reference chamber 192. Conductive washer 168 serves as the common electrode between chambers 190 and 192 and supplies an input signal to a voltage follower 200. Besides the ionization chamber assembly, all of the other stages are supplied as necessary for operation from the positive terminal of the same battery 84 and returned through a common bus to the negative terminal of that battery.

FIG. 15 depicts the major system components and enables a generalized description of overall operation. When smoke enters chamber 190, the voltage which is seen at the input of follower 200 decreases. Follower 200 outputs essentially the same voltage and is impedance matched to one input of a smoke comparator 202. A potentiometer 204 provides a second input to comparator 202. Normally, the level of the input voltage from potentiometer 204 is at a lower voltage than that from the output of follower 200. When smoke is present in chamber 190, the output from follower 200 decreases to a point where it equals the output level from potentiometer 204, as a result of which comparator 202 trips. When comparator 202 trips, it provides a signal to one input of an OR gate 206, and the output from gate 206 activates a power switch 208 that energizes an acoustical arrangement.

The acoustical arrangement is composed of a ramp generator 210 that modulates a voltage controlled oscillator 212. Oscillator 212 feeds a square-wave output signal of variable frequency to a power amplifier 214. Amplifier 214, in turn, drives acoustical transducer 114. Transducer 114 includes an acoustical baffle 216 that is snapped onto the housing of transducer 114 and has sound outlet openings 218. Baffle 216 serves to develop approximately an additional 6dB of output sound level.

The lower left-hand portion of FIG. 15 is part of a monitor for determining the condition of battery 84. Operation of this monitoring function is initiated by an eight-second timed oscillator 220 the output from which is fed as an input both to a power switch 222 and to a reference generator 224. For the present embodiment in which battery 84 normally exhibits a voltage across its terminals of nine volts, generator 224 provides a reference voltage of 6.2 volts. Power switch 222 activates light-emitting diode 150; that is, a pulse from oscillator 220 enables a pulse to exit from power switch 222 that, in turn, pulses LED 150.

During the same time interval that LED 150 is activated, reference generator 224 is enabled to provide a reference level to a low battery comparator 226. The other input to comparator 226 is a voltage which corresponds to the actual voltage of battery 84. When that actual battery voltage level drops to a pre-determined level, the two different inputs to comparator 226 become nearly identical at which point comparator 226 trips. That tripping of the comparator provides a second input signal to OR gate 206 and causes actuation of power switch 208. Comparator 226, however, is only activated while timed oscillator 220 is providing a pulse output. Consequently, all that is fed through comparator 226 to gate 206 is a pulse of short duration. In turn, that short duration pulse results in the production of a limited duration pulse or "thunk" sound from acoustical transducer 114.

Figure 16:
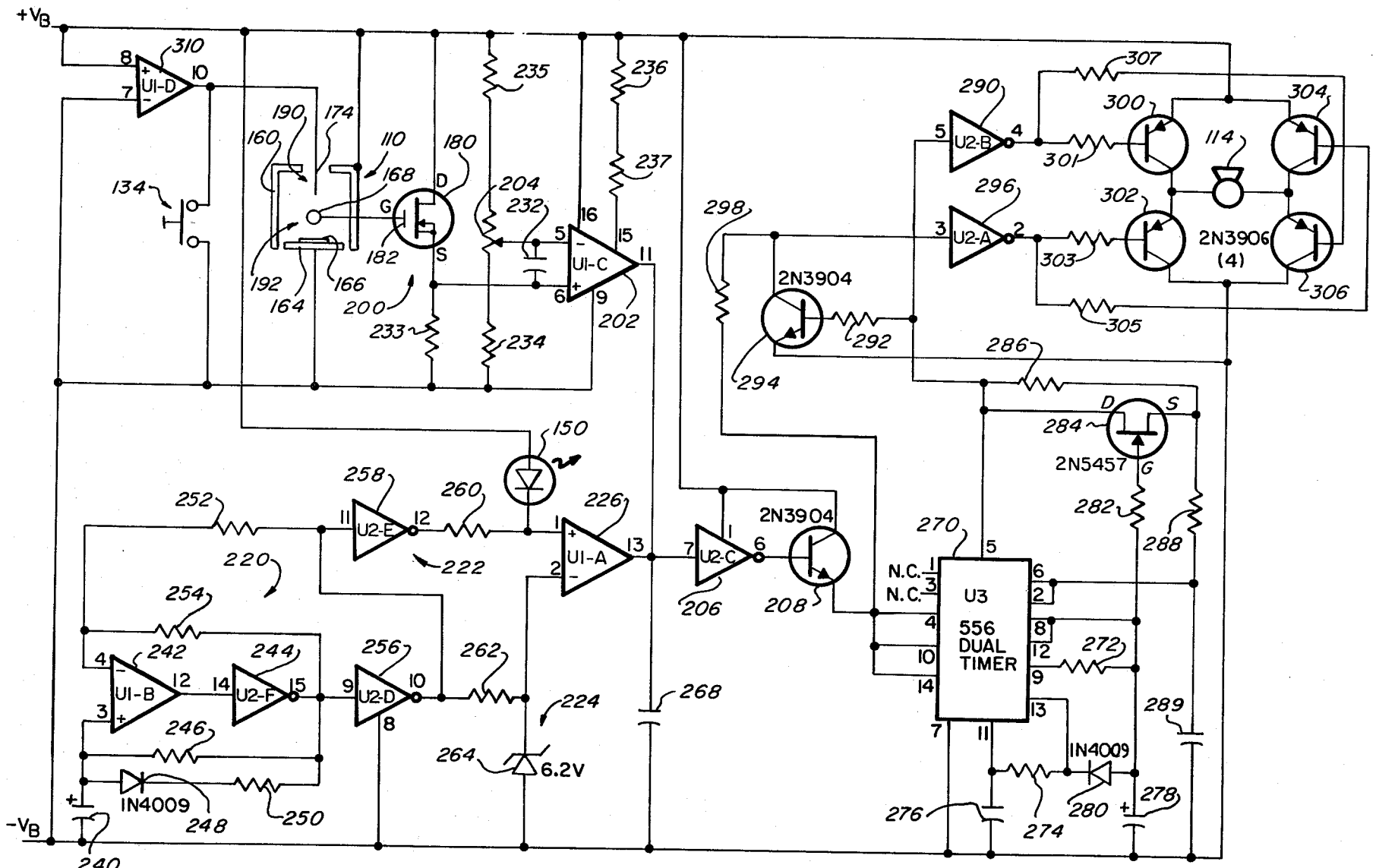
FIG. 16 is a schematic diagram of that system.

FIG. 16 is a detailed schematic diagram. The overall layout roughly parallels that of the block diagram of FIG. 15. Its upper left-hand quadrant contains primarily the smoke sensing and certain self-test circuitry. In the lower-left quadrant is the low-battery comparison circuitry. What is generally in the right half of the diagram constitutes the acoustical output arrangement.

Basically, the smoke sensor portion of the overall system includes ionization chamber assembly 110, field-effect transistor 180, comparator 202, potentiometer 204, a noise suppressing capacitor 232 connected across the input terminals of comparator 202, and appropriate voltage dividing and developing resistances 233, 234, 235, 236 and 237 as illustrated. The output of comparator 202 is fed as one input to OR gate 206. As particularly embodied, comparator 202 is one-fourth of an overall integrated circuit which also contains comparator 226 and other sepcific comparators yet to be described; a suitable integrated circuit is SL6101 supplied by Siliconix Corporation. The different comparators used throughout the systems all have the labeling prefix "U1". Similarly, the overall system utilizes a number of inverters or NOT-connectives indicated by the common prefix symbol "U2". Gate 206 and other such components all may be contained in a single CD4049AE integrated circuit. It features an extremely high input impedance for each inverter, while exhibiting output impedances that are sufficiently low to drive resistances greater than approximately ten kilohms. Each inverter is capable of sourcing and sinking 15 milliamperes direct current with no more than one-half-volt drop across the device. In all cases, the individual discrete components as represented in FIG. 16 include pin numbers as assigned by the manufacturers with respect to the device depicted.

Operation of ionization chamber assembly 110 is similar to the dual ionization chambers which have become somewhat of an industry standard. The one portion 190 of the overall chamber assembly has access to the external environment, while access from that environment to the other portion 192 is comparatively restricted. Ionization takes place in both chambers 190 and 192. In accordance with well-known principles, increased resistance to current flow is exhibited in the presence of smoke. As a result, the voltage which appears on the lead from washer 168 to gate 182 of field effect transistor 180 decreases in proportion to the smoke density or the amount of smoke or other combustion product.

The voltage on pin 5 of comparator 202, derived from potentiometer 204, normally is adjusted to be about five volts. On the other hand, the potential ultimately delivered to pin 6 of comparator 202 from transistor 180 is about six volts direct current with clear air within smoke chamber 190. Thus the difference between the two different inputs to comparator 202 represents a sensitivity voltage of approximately one volt. When smoke enters chamber 190, the voltage at pin 6 is reduced. When it is reduced below the five volts on pin 5 of comparator 202, the output of that comparator, which theretofore was plus, drops to zero. Thus, the presence of a certain level of smoke in chamber 190 is represented by a level which appears at the output pin 11 of comparator 202. As already indicated, that output level is fed as an input to gate 206.

The detailed adjustment of the smoke sensor circuitry remains somewhat empirical. This arises, in part, because of the lack of correspondence between the presence of visible smoke particles and those which actually are detected. With respect to the chamber assembly, a highly successful model utilizes a shell 160 that has a diameter of one inch in width with all other dimensions being proportionately represented in the drawings. Typically, proper operation is obtained with the voltage on the wiper of potentiometer 204 being set to a level of approximately one volt less than that at the output of transistor 180, the latter having a nominal value of six volts in the present embodiment.

Included within the overall low-battery monitor portion of the system is what may be termed a flasher circuit for LED 150. In general, operation of the flasher circuit is predicted upon the slow charge and very rapid discharge of a capacitor 240 which forms part of oscillator 220. Oscillator 220 then drives power switch 222 so as to activate LED 150 for a short period of time in order to produce a flash of light from the LED.

More particularly, oscillator 220 includes a comparator 242 having input pins 3 and 4. Its output, from pin 12, drives an inverter 244. Upon initial application of the power from battery 84 to the system, capacitor 240 is at zero voltage and the output from inverter 244 is high. Thereupon, capacitor 240 charges through a resistor 246 having a related value such that the charging time constant is eight seconds. The voltage appearing across capacitor 240 is applied to input pin 3 of comparator 242. The different dividing resistances are selected so that the other input pin 4 of comparator 242 receives a supply voltage of six volts or two-thirds of the battery supply voltage. When capacitor 240 charges to that six volt level, comparator 242 switches as a result of which the output at pin 15 of inverter 244 is caused to switch low. Thereupon, capacitor 240 is rapidly discharged through a diode 248 and a resistor 250. The resistance values are selected so that capacitor 240 is discharged to a value of approximately three volts or one-third of the battery supply voltage; that level is set by the divider combination of resistors 252 and 254.

As a result of the foregoing action, a pulse appears at the output of inverter 244 which normally is high but which goes low for a period of approximately one millisecond. That pulse is inverted in an inverter 256 and then inverted once again in a further inverter 258. Inverter 258, together with inverter 256, serves as power switch 222. The output of inverter 258 is high except for the one millisecond pulse. During that short pulse period, the output of inverter 258 goes low, causing the full supply voltage of nine volts to be applied across LED 150 and a resistor 260 which serves as a current limiter. LED 150 thereupon is activated to emit a flash of light. That light emission ceases at the end of the one millisecond period at which point in time oscillator 220, including comparator 242, returns to an eight second timing cycle. It should be noted that LED 150 exhibits a voltage drop in operation, in this case in an amount of approximately 1.65 volts at a current of ten milliamperes. As will be seen, that voltage drop is utilized in the low-battery monitoring circuit next to be discussed.

Turning, then, to that monitoring circuit, it will be seen that it makes substantial use of the LED flashing circuitry. Essentially, the low-battery monitor includes comparator 226, inverters 256 and 258, resistor 260 and LED 150. In addition, the output from pin 10 of inverter 256 is coupled over a resistor 262 to input pin 2 of comparator 226 which also is returned to common through a 6.2 volt zener diode 264. Input pin 1 of comparator 226 is connected to the junction between LED 150 and resistor 260.

As previously indicated, the voltage level at output pin 10 of inverter 256 is a normally low signal which pulses high for a one millisecond period of time. When that output pulse is high, a voltage is applied by way of resistor 262 that effects zener action of diode 264 so as to maintain a regulated value of 6.2 volts. That latter level is applied to input pin 2 of comparator 226. During the same time that the positive pulse is applied across resistor 262, a negative pulse is applied across resistor 260 in order to activate LED 150. Since input pin 1 of comparator 226 is connected to the cathode side of LED 150, that pin is always at either the full supply voltage of nine volts or at a value of approximately 1.65 volts less than the battery supply by reason of the voltage drop across LED 150 when activated.

When the voltage from battery 84 decreases sufficiently, the voltage level at pin 1 of comparator 226 drops below the voltage level at pin 2 of that comparator. When that happens, comparator 226 is enabled as a result of which a negative-going signal appears at its output pin 13. Because those inputs of comparator 226 will, in effect, cross over for at most a period of one millisecond, it follows that the output signal at pin 13 of comparator 226 has a duration also of one millisecond. That is, output pin 13 of comparator 226 is always high except under a low-battery condition in which case that output is low for the one millisecond period of time. It is to be observed that the low-battery pulse can only be given during the time that LED 150 is activated; at other times, the circuitry is normally in a non-test mode.

It may be noted that the illustrated batterymonitoring technique minimizes power consumption for that test, because the only time that current is required is during the approximately one millisecond test period. That is, the testing is done only at the same time that LED 150 flashes. Resistor 260 is sized to provide the current through LED 150 necessary to create a drop, as mentioned, of 1.65 volts. In the illustrated circuit, therefore, a low-battery voltage indication is given when it is reduced to 7.85 volts.

As has already been observed, either of comparators 202 or 226 is capable of having its output switched low under the respective conditions of smoke detection or low-battery indication. Those two effects are integrated by tieing the respective output pins of those comparators in common to the input of gate 206 which in this case is another inverter. A capacitor 268 is connected between common and the input of gate 206. One function of capacitor 268 is to suppress cross-talk which may otherwise occur between different portions of the integrated circuitry which contains the different comparators and inverters. In addition, capacitor 268 serves to stretch the pulse at the output of comparator 226 from approximately the one millisecond period of time previously mentioned to about six milliseconds. Thus, the low battery "thunk" time is significantly extended and, therefore, more easily heard.

When the output of either of comparators 202 or 226 goes low, the output from inverter 206 becomes high and activates power switch transistor 208. Upon being turned on, transistor 208 activates a standard 556 Dual Timer integrated circuit 270. The first timer within circuit 270 utilizes resistors 272 and 274, capacitors 276 and 278 and diode 280 to provide a ramp voltage at the upper or positive side of capacitor 278. That positive ramp voltage is fed over a resistor 282 to the gate of a field effect transistor 284. As the ramp voltage increases, the resistance presented by transistor 284 decreases to a value at which it substantially shorts a resistor 286 connected between the drain and source terminals. Resistor 286 and a resistor 288 returned to common over a capacitor 289, along with transistor 284, function as a series/parallel resistance combination which serves to change the basic oscillation frequency of what in the overall amounts to oscillator 212. That frequency appears at the output of the second timer which is at pin 5 of circuit 270. The described resistance-varied modulating function effects a frequency change between approximately one kilohertz and three kilohertz as seen at pin 5 of circuit 270. Capacitor 289 is an integral part of the voltage-controlled oscillator function, being a determinant of its frequency.

In more detail, the first timer within circuit 270 is utilized to generate a ramp voltage which then is employed in conjunction with a second timer to develop a frequency-modulated square-wave signal. As is known for circuit 270, as such, each timer section includes a threshold comparator, a trigger comparator and a flip-flop. Activation of the threshold comparator will reset the flip-flop output low and activation of the trigger comparator will set the flip-flop high. When transistor 208 conducts, power is supplied to circuit 270. The ramp generator operation begins by setting terminal 9 of circuit 270 high. The voltage on capacitor 278 begins to rise as a result of current supplied through resistor 272. That voltage rise activates the threshold comparator at approximately two-thirds of the voltage at terminal 14; in turn, terminal 9 is reset low. At the same instant, terminal 12 provides a ground path so as to re-adjust the level on the trigger comparator to a low and to enable a very rapid discharge of capacitor 278. Accordingly, the voltage waveform on capacitor 278 is of sawtooth shape. When the charging action creates a voltage on capacitor 278 which is about two-thirds of that delivered from transistor 208, a substantially instantaneous discharge takes place.

The indicated modulated frequency range of the signals created by the second timer is circuit 270 is only approximate. Analysis of the specifically illustrated circuitry and of the components reveals that, on the basis of a worst-case analysis expected from different individual components, the minimum might be two-hundred or so hertz lower and the maximum could increase by as much as nearly one hundred-fifty percent. However, such variations do not, in commercial reality, adversely affect the user in terms of giving the desired alert.

The frequency-ramped signal from pin 5 of circuit 270 is fed, first of all, to the input of an inverter 290. That frequency-ramped signal also is connected over a resistor 292 to drive a transistor 294. Transistor 294 yields a phase inverted signal which is fed to the input of still another inverter 296. A pull-up resistor 298 is connected from the input of inverter 296 to the output of transistor 208.

Inverter 296 yields a second signal inversion so that the basic frequency at its output is returned to a condition of zero degrees phase shift. Thus, the signal at the output of inverter 296 has a phase shift of zero degrees, while the signal at the output of inverter 290 appears with a phase shift of one hundred-eighty degrees. The outputs of inverters 290 and 296 are connected to drive alternate pairs of transistors 300, 302, 304 and 306 through respective resistors 301, 303, 305 and 307. Those transistors are so interconnected in a bridge network that transistor 300 is on at the same time as transistor 306, and transistor 302 is on at the same time as transistor 304. Consequently, direct current is fed back and forth through the coil of transducer 114. It may be noted that a secondary function of transistor 294 is to insure that the entire transistor driving stage cannot be on simultaneously; this avoids overloading.

It will be observed that, during the non-alarm stage, the outputs of both of comparators 202 and 226 are high, so that the output of inverter OR gate 206 is low. In that condition, transistor 208 is cut off and the entire circuitry beyond that transistor is devoid of positive supply voltage with the exception of the final output bridge network; with a voltage at zero level applied to the inputs of both inverters 290 and 296, the outputs thereof are both high so that all of transistors 300, 302, 304 and 306 are in a non-conductive condition.

Figure 13:
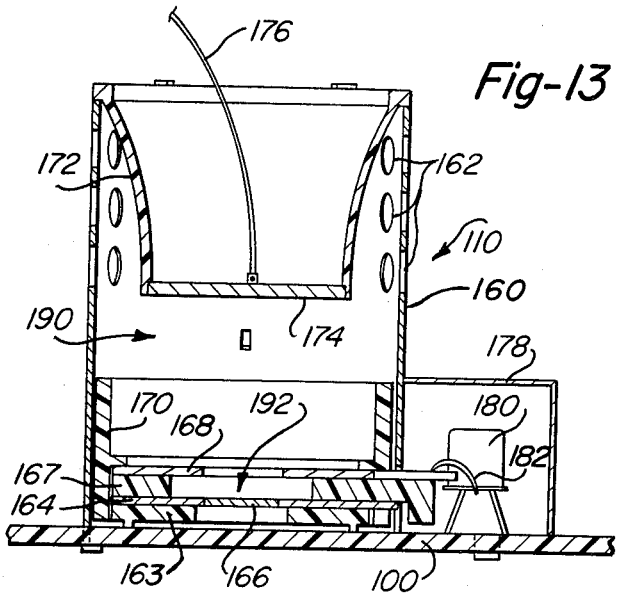
FIG. 13 is a fragmentary cross-sectional view taken along the line 13—13 in FIG. 9.

Finally with regard to FIG. 16, there is included circuitry for obtaining the function from test switch 134 as it relates to ionization chamber 110 in order to simulate a smoke condition. Another comparator 310 is employed as a current source. Connected as illustrated, its output terminal at pin 10 always remains high unless switch 134 is actuated so as to close its contacts. The positive or high voltage which appears at output pin 10 of comparator 310 is fed to the probe within smoke chamber 190 which takes the form of conductive plate 174. Under that condition, chamber 190 is ready to detect the entrance of smoke particles. Upon closure of switch 134, however, the voltage level appearing at output pin 10 of comparator 310 is reduced to zero. That reduction in voltage level redistributes the field pattern within the confines of chamber assembly 110. With the height of plate 174 positioned within chamber 190 as illustrated in FIG. 13 relative to the other chamber components, a pseudo-smoke condition is achieved. That change in the distribution of the field pattern effects a decrease in the output voltage fed from chamber assembly 110 to transistor 180, in a manner which fully simulates a smoke condition. Within one or two seconds following the closure of switch 134, transducer 114 sounds an alarm signal the same as if actual smoke had been detected.

It should be noted that, when switch 134 is closed, the current limiting nature of that comparator is utilized. By using the comparator, its pin 10 can be grounded by switch 134 without requiring a pull-up resistor. That feature enables an essentially zero potential to appear on plate or probe 174 so as to disrupt the field pattern in a manner similar to that occasioned by the existence of smoke particles. The amount of smoke which is simulated varies with the depth by which plate 174 is positioned within chamber 190. As illustrated, that depth was selected to achieve a four percent/foot plus or minus one percent/foot smoke obscurity as measured by techniques prescribed in U. L. 217 standard published by Underwriters Laboratories.

As a corollary to the foregoing, probe or conductive element 174 may be mounted within chamber 190 so as to be adjustable in depth of insertion within that chamber. This provides a means for testing different limits of variation in smoke obscurity for a given chamber design and/or sensing output circuitry. As indicated, the depth of insertion of probe 174 within chamber 190 is one control parameter governing the amount of simulation of a smoke condition. One contemplated alternative is to utilize a plurality of differently-depthed probes selectively connectable so as to permit adjustment of the simulation to different degrees of smoke or other particle determination that might be desirable at different times.

One limitation upon any device of this kind is battery 84. Considering the present state of the art, alkaline cells are preferred by reason of their long shelf life, low internal impedance and superior energy per unit volume ratio. However, other batteries may be employed in order to avoid higher costs and, perhaps, less widespread availability in retail outlets. In any event, the battery selected should afford a significant life, such as one year, and it should be capable of sustaining a low-battery warning for a worthwhile period such as a week. Such criteria lead to a consideration of current hours remaining versus a given battery voltage, recognizing that most batteries present an ever-decreasing voltage curve. Another point of interest is the battery resistance characteristic, although that is less important with the ramp-type sound output of the described arrangement than it would be with a simple single-frequency horn. With the illustrated arrangement, the internal impedance of the battery seems to be important only insofar as it be reasonably low, such as below eight ohms. At least ordinarily, that value will not be exceeded until the voltage is well outside the range of concern for the illustrated circuit. Extensive experimentation has suggested that a conservative minimum point to activate comparator 226 is 6.6 volts. That is deemed to be a minimum. A more desired level is 7.85 volts, yielding a nominal or typical unit which should operate for years on a given battery before a trouble signal is given and providing a significant safety factor for operation of the low-battery alarm.

As will be seen, the overall system includes a number of different features. In terms of rather broad reference, there is (1) a smoke sensor, (2) a visual light indication of operability, (3) a low-battery monitor, (4) an acoustical signal generator and (5) a smoke simulator for testing. Each of these sub-systems as disclosed has its own advantageous features, and each might be used as a part of some otherwise different system in the overall. The described chamber assembly is capable of being used with entirely different, including known, circuitry. The smoke-simulation test approach finds applicability to other chamber arrangements as well as with other circuitry. The low-battery monitor and the visual indication scheme similarly may be separated and used elsewhere. Of course, a simple single-frequency tone generator may be substituted in the drive which feeds acoustical transducer 114. In one alternative to that effect, inverter 206 is utilized to enable the energization of a silicon-controlled rectifier connected in series with an output transducer so as to create a continuous sound. Instead of having its own acoustical transducer, the system may feed an output signal to a central monitoring station at a remote location. Switch assembly 112 may be differently structured or located elsewhere. Clearly, other forms for the housing and/or its mounting may be substituted. What has been described and illustrated herein represents a preferred embodiment based upon a sustained engineering effort devoted to a high degree of reliability coupled with reasonable cost of the end product. Present indications are that reliability in operation may be so great as to be stated in terms of less than two failures per million hours of operation and that costs will be commensurate with present industry levels.

While particular embodiments of the invention have been shown and described, and numerous alternatives and modifications have been suggested, it will be obvious to those skilled in the art that changes and further modifications may be made without departing from the invention in its broader aspects, and, therefore, the aim in the appended claims is to cover all such changes and modifications as fall within the true spirit and scope of the invention.

We claim:

1. In a system for detecting the existence of a combustion process and which includes means for sensing the existence of that process and means for indicating the occurrence thereof, the improvement comprising:

a housing having spaced top and bottom walls and defining a cavity in which electronic circuitry of said system is contained, said housing including aperture means through which smoke to be detected is admitted;

means defining an opening in said housing;

a resiliently-biased pushbutton seated in said opening;

means responsive to depression of said pushbutton for simulating the existence of said process and effecting operation of said indicating means;

a visible light-emitting device included within said pushbutton;

and means for periodically energizing said device independently of said pushbutton, to indicate operativeness of said system.

2. A system as defined in claim 1 which further includes means responsive to operation of said device for representing impending failure of a power source that energizes said device.

3. A system as defined in claim 1 in which said electronic circuitry of said system is disposed on a substrate mounted to said top wall, in which a switch actuator supports said pushbutton from and above said substrate, and in which said responsive means includes a movable switch element mounted on said substrate in a location to be moved by said actuator.

4. In a system for detecting the existence of a combustion process and which includes means for sensing the existence of that process and means for indicating the occurrence thereof, the improvement comprising:

said sensing means having an elongated electrically conductive tube that forms an essential part of an ionization-type of said sensing means and which also includes an internally transverse conductive member for establishing an electric field extending therefrom to said tube with said field being subject to change upon the presence of products of said combustion process;

an electrically-conductive probe positioned within said tube in a location intermediate the extent of said electric field;

and means for addressing said probe in a manner that it creates a simulation of the existence of said process by altering the condition of said electric field.

5. A system as defined in claim 4 in which said probe is suspended transversely within and intermediate the length of a chamber defined by said tube.

6. A system as defined in claim 4 in which said tube is perforated in one end portion for admitting smoke particles, in which an insulative sleeve is fastened and spaced within said one portion, and in which said probe is a conductive plate secured on the inner end of said sleeve.

7. A system as defined in claim 4 which further includes means for biasing said probe in a direction to cause a response within said tube which simulates that caused by the reception within said tube of particles of smoke.

8. In a system for detecting the existence of a combustion process and which includes means for sensing the existence of that process and means for indicating the occurrence thereof, the improvement comprising:

means included in said sensing means defining a chamber to the interior of which there is access by surrounding air and any smoke particles therein, within which chamber radioactive emissions occur, and through which chamber an electric field is distributed;

means, including said indicating means, responsive to a change in distribution of said field gradient for producing an alarm signal;

an electrically-conductive probe disposed within said chamber;

means for selectively impressing a potential on said probe of a value changing said distribution sufficiently to enable operation of a test signal;

a source of electrical power for energizing said sensing means and said indicating means;

means for coupling said power source to said probe to impress said potential thereon;

and an element connected across said power source for producing said potential and included within said coupling means, said element limiting current drawn thereby from said power source to a predetermined level.

9. In a system for detecting the existence of a combustion process and which includes means for sensing the existence of that process and means for indicating the occurrence thereof, the improvement comprising:

said sensing means having a chamber that forms an essential part of an ionization-type of said sensing means;

an electrically-conductive probe positioned within and insulated from said chamber;

and means for adjusting said probe in a manner that it creates a simulation of the existence of said process, the amount of said process simulated being a function of the depth by which said probe is positioned within said chamber.

10. A system as defined in claim 9 in which said adjusting means includes means for enabling development of a test signal.

11. A system as defined in claim 10 in which said test signal is a representation that said amount of said process is being simulated.

12. A system as defined in claim 9 which includes means for permitting adjustment of the degree of said process simulated.

* * * * *